US008509469B2

(12) United States Patent
Miller, III et al.

(10) Patent No.: US 8,509,469 B2
(45) **Date of Patent: *Aug. 13, 2013**

(54) IMPLANTABLE MICROPHONE WITH SHAPED CHAMBER

(75) Inventors: Scott Allan Miller, III, Littleton, CO (US); Robert Edwin Schneider, Erie, CO (US)

(73) Assignee: Cochlear Limited, Macquarie University (AU)

( * ) Notice: Subject to any disclaimer, the term of this patent is extended or adjusted under 35 U.S.C. 154(b) by 183 days.

This patent is subject to a terminal disclaimer.

(21) Appl. No.: 13/030,821

(22) Filed: Feb. 18, 2011

(65) Prior Publication Data

US 2011/0200222 A1 Aug. 18, 2011

Related U.S. Application Data

(63) Continuation of application No. 12/368,854, filed on Feb. 10, 2009, now Pat. No. 7,903,836, which is a continuation of application No. 11/336,394, filed on Jan. 20, 2006, now Pat. No. 7,489,793.

(60) Provisional application No. 60/697,759, filed on Jul. 8, 2005.

(51) Int. Cl.
*H04R 9/08* (2006.01)

(52) U.S. Cl.
USPC ..... 381/361; 381/355

(58) Field of Classification Search
USPC ..... 381/151, 170, 191, 326, 355, 359, 381/362, 361, 369, 380; 600/25; 607/56, 607/57; 181/158, 161, 163
See application file for complete search history.

(56) References Cited

U.S. PATENT DOCUMENTS

| | | | |
|---|---|---|---|
| 4,443,666 | A | 4/1984 | Cote |
| 4,450,930 | A | 5/1984 | Killion |
| 4,504,703 | A | 3/1985 | Schneiter et al. |
| 4,532,930 | A | 8/1985 | Crosby et al. |
| 4,606,329 | A | 8/1986 | Hough |
| 4,607,383 | A | 8/1986 | Ingalls |
| 4,621,171 | A | 11/1986 | Wada et al. |
| 4,774,933 | A | 10/1988 | Hough et al. |
| 4,815,560 | A | 3/1989 | Madaffari |
| 4,837,833 | A | 6/1989 | Madaffari |
| RE33,170 | E | 2/1990 | Byers |
| 4,932,405 | A | 6/1990 | Peeters et al. |
| 4,936,305 | A | 6/1990 | Ashtiani et al. |
| 5,015,224 | A | 5/1991 | Maniglia |
| 5,105,811 | A | 4/1992 | Kuzma |
| 5,163,957 | A | 11/1992 | Sade et al. |

(Continued)

*Primary Examiner* — Brian Ensey
(74) *Attorney, Agent, or Firm* — Lowe Hauptman Ham & Berner, LLP

(57) ABSTRACT

An implantable microphone is disclosed having an external diaphragm and housing that forming chamber capable of being pressurized by deformational movement of the diaphragm induced by pressure waves (e.g., acoustic signals) propagating through overlying tissue. The chamber is shaped such that the volume of the chamber upon deflection of the diaphragm is reduced compared to a static volume of the chamber (i.e., volume of the chamber with no diaphragm deflection). As a result, the change in pressure within the chamber for a given diaphragm displacement is greater than it would be within a chamber having a cylindrical volume, leading to greater microphone sensitivity. In one arrangement, the chamber is shaped such that it is deeper at its center than at its edges, for example, to form a conical or paraboloidal volume.

20 Claims, 7 Drawing Sheets

(56) References Cited

U.S. PATENT DOCUMENTS

| | | | | |
|---|---|---|---|---|
| 5,176,620 | A | 1/1993 | Gilman | |
| 5,277,694 | A | 1/1994 | Leysieffer et al. | |
| 5,363,452 | A | 11/1994 | Anderson | |
| 5,411,467 | A | 5/1995 | Hortmann et al. | |
| 5,456,654 | A | 10/1995 | Ball | |
| 5,554,096 | A | 9/1996 | Ball | |
| 5,558,618 | A | 9/1996 | Maniglia | |
| 5,624,376 | A | 4/1997 | Ball et al. | |
| 5,702,431 | A | 12/1997 | Wang et al. | |
| 5,749,912 | A | 5/1998 | Zhang et al. | |
| 5,762,583 | A | 6/1998 | Adams et al. | |
| 5,795,287 | A | 8/1998 | Ball et al. | |
| 5,800,336 | A | 9/1998 | Ball et al. | |
| 5,814,095 | A | 9/1998 | Muller et al. | |
| 5,842,967 | A | 12/1998 | Kroll | |
| 5,857,958 | A | 1/1999 | Ball et al. | |
| 5,859,916 | A | 1/1999 | Ball et al. | |
| 5,881,158 | A | 3/1999 | Lesinski et al. | |
| 5,888,187 | A | 3/1999 | Jaeger et al. | |
| 5,897,486 | A | 4/1999 | Ball et al. | |
| 5,906,635 | A | 5/1999 | Maniglia | |
| 5,913,815 | A | 6/1999 | Ball et al. | |
| 5,951,601 | A | 9/1999 | Lesinski et al. | |
| 6,093,144 | A | 7/2000 | Jaeger et al. | |
| 6,422,991 | B1 | 7/2002 | Jaeger | |
| 6,626,822 | B1 * | 9/2003 | Jaeger et al. | 381/326 |
| 6,707,920 | B2 | 3/2004 | Miller | |
| 2002/0124656 | A1 * | 9/2002 | McIntosh | 361/278 |

* cited by examiner

IMPLANTABLE MICROPHONE WITH SHAPED CHAMBER

CROSS REFERENCE TO RELATED APPLICATIONS

This application is a continuation of U.S. patent application Ser. No. 12/368,854 having a filing date of Feb. 10, 2009, which is a continuation of U.S. patent application Ser. No. 11/336,394 having a filing date of Jan. 20, 2006 which issued as U.S. Pat. No. 7,489,793 and which claimed the benefit of the filing date of U.S. Provisional Application No. 60/697,759 and having a filing date of Jul. 8, 2005, the content of which is incorporated by reference herein.

FIELD

The present invention relates to implanted microphone assemblies, e.g., as employed in hearing aid instruments, and more particularly, to implanted microphone assemblies having enhanced pressure sensitivity.

BACKGROUND

In the class of hearing aids generally referred to as implantable hearing instruments, some or all of various hearing augmentation componentry is positioned subcutaneously on, within, or proximate to a patient's skull. Generally, implantable hearing instruments are divided into two sub-classes, namely, semi-implantable and fully implantable. In a semi-implantable hearing instrument, one or more components such as a microphone, signal processor, and transmitter may be externally located to receive, process, and inductively transmit an audio signal to implanted components such as a transducer. In a fully-implantable hearing instrument, typically all of the components, e.g., the microphone, signal processor, and transducer, are located subcutaneously. In either arrangement, an implantable transducer is utilized to stimulate a component of the patient's auditory system (e.g., tympanic membrane, ossicles and/or cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate causing stimulation of the cochlea through its natural input, the so-called oval window.

As may be appreciated, implantable hearing instruments that utilize an implanted microphone require that the microphone be positioned at a location that facilitates the receipt of acoustic signals. For such purposes, such implantable microphones are most typically positioned in a surgical procedure between a patient's skull and skin, often at a location rearward and upward of a patient's ear (e.g., in the mastoid region). Because the diaphragm of an implantable microphone is covered by tissue (e.g., skin), ambient acoustic signals are attenuated by this tissue. Accordingly, it is desirable that the acoustic sensitivity (e.g., pressure sensitivity) of an implanted microphone be enhanced to allow for detection of low amplitude/magnitude ambient acoustic signals.

SUMMARY

Accordingly, it is one objective to provide an implantable microphone having enhanced pressure sensitivity. To achieve such an enhanced sensitivity, an implantable microphone is disclosed with an external diaphragm and housing forming a chamber capable of being pressurized by deformational movement of the diaphragm induced by pressure waves (e.g., acoustic signals) propagating through overlying tissue. The chamber is shaped such that the ratio of its total volume to a volume displaced/swept out and/or compressed (e.g., generally displaced) by the deformed diaphragm in response to pressure waves is small when compared with the same ratio for a chamber having a cylindrical volume. That is, the volume of the chamber upon deflection of the diaphragm is reduced compared to a static volume of the chamber (i.e., volume of the chamber with no diaphragm deflection). As a result, the change in pressure within the chamber for a given diaphragm displacement is greater than it would be within a chamber having a cylindrical volume, leading to greater microphone sensitivity. In one arrangement, the chamber is shaped such that it is deeper at its center than at its edges, for example, to form a conical or paraboloidal volume. Stated otherwise, the bottom of the chamber may be shaped to substantially match a deformation profile of a diaphragm. Such a shaped chamber has the desirable property that it reduces the overall volume of the chamber while still permitting the diaphragm to deflect without interference over a predetermined operating range (e.g., up to a maximum sound pressure level or pressure differential).

As may be appreciated, a generally cylindrical chamber has a greater volume than is required to accommodate deflection of the diaphragm over its operating range. For this reason, the pressure developed within a cylindrical chamber for a given diaphragm deflection will be less than the pressure developed within a shaped chamber. As a result, a microphone using the shaped chamber will possess a greater pressure sensitivity than a microphone using a cylindrical chamber. Having a greater pressure sensitivity for a given level of noise generated by a microphone element requires less gain to generate an output of a predetermined level. Accordingly, the apparent noise to a user is advantageously reduced. This results in less fatigue and better intelligibility and sound quality for the user.

According to a first aspect of the present invention, an implantable microphone having enhanced pressure sensitivity is provided. The microphone includes a housing having a diaphragm sealably positioned across a recessed surface of the housing. The recessed surface and the diaphragm collectively define a chamber and the diaphragm defines a reference plane. The depth of the recessed surface varies relative to the reference plane across at least a portion of a width of the recessed surface. A pressure sensitive element is operatively interconnected to the chamber to detect pressure fluctuations in the chamber and generate an output signal.

Various refinements exist of the features noted in relation to the first aspect of the present invention. Further features may also be incorporated in the first aspect of the present invention as well. These refinements and additional features may exist individually or in any combination. For instance, the pressure sensitive element may be any element that is operative to generate an output that is indicative of a pressure within the chamber. In one arrangement, the pressure sensitive element is an electroacoustic transducer. Such a transducer may be interconnected to the chamber by, for example, a port that extends through the recessed surface and/or an edge surface of the chamber. In another arrangement, an electrically conductive element forms part or all of the recessed surface. In this arrangement, the electrically conductive element and diaphragm may form a pressure sensitive electret. In a further arrangement, a pressure sensitive element such as an electret element (e.g., a piezoelectric material) may be disposed within the chamber.

Generally, across at least a portion of the width of the recessed surface the depth may vary such that the center portion of the recessed surface is deeper than peripheral portions of the recessed surface. In this regard, a depth of a peripheral edge of the recessed surface may be less than a first depth at a first location spaced from the peripheral edge of the recessed surface. Likewise a second depth at a second location may be greater than the first depth, where the second location is spaced further from the peripheral edge than the first location. In one arrangement, the depth of the recessed surface, over at least a portion of its width, may increase as a function of a horizontal distance from the edge of the recessed surface. In such an arrangement, the depth of the recessed surface may increase linearly or non-linearly as a function of the distance. For instance, all or a portion of a profile of the recess may be conical or parabolic. In a further arrangement, the depth of the recessed surface may continually increase from an edge of the recess to a midpoint of the recess.

In one arrangement, where the depth of the recessed surface generally increases from a peripheral edge to a mid-point of the recessed surface, the depth of the recess may range from 0.0 inches at the peripheral edge to about 0.0050 inches at a center portion of the recessed surface. In a further arrangement, the peripheral edge may have a depth that ranges from about 0.0002 inches to about 0.0010 inches and a center portion may have a depth that ranges from about 0.0020 inches to about 0.0050 inches. In such arrangements, a total volume of the chamber (e.g., when the diaphragm is static/non-deflected) may be less than about 15 cubic millimeters. In another arrangement, the total volume may be less than about 7 cubic millimeters. Likewise, a overall width of the recessed surface may be selected to obtain a desired volume. For instance, a diameter of a circular recessed surface may be less than about 30 mm.

In a further arrangement, the recessed surface may be shaped such that it substantially matches a deflection profile of the diaphragm. In this regard, the depth of the recessed surface may be selected such that the entirety of the recessed surface is within a predetermined distance of the diaphragm when the diaphragm deflects in response to a predetermined pressure differential. For instance, in one arrangement the entirety of the recess surface may be disposed within about 0.0015 inches upon deflection. In a further arrangement, the entirety of the recessed surface may be disposed within about 0.0005 inches upon deflection.

One or more properties of the diaphragm may be selected, for example, to facilitate any of the above noted arrangements. For instance, in one arrangement the diaphragm may have a modulus of elasticity of greater than about 70 GPa. In a further arrangement the diaphragm may have a modulus of elasticity of greater than about 100 GPa. The thickness of the diaphragm may also be selected to provide one or more desired properties. For instance, the thickness may range between about 0.0002 inches and about 0.008 inches.

According to another aspect of the present invention, an implantable microphone having a reduced volume is provided. The microphone includes a housing having a diaphragm that is sealably positioned over the surface of the housing to define a chamber. The chamber has a first volume when the diaphragm is in a static/non-deflected position. A pressure sensitive element is operatively interconnected to the chamber for detecting pressure fluctuations therein and generating an audio output signal. The chamber has a second volume when the diaphragm is deflected in response to a predetermined pressure differential. To provide an output signal having an enhanced magnitude, a ratio of the second volume divided by the first volume is less than about 0.4. In a further arrangement, this ratio is less than about 0.2. In a still further arrangement, this ratio is less than about 0.1. Such low volume ratios allow for generating increased pressures within the chamber that permit the pressure sensitive element to generate an output signal of a greater magnitude.

The predetermined pressure differential across the diaphragm may be any benchmark measurement. For instance, such a measurement may correspond to maximum expected sound pressure level (SPL) that is expected to be received by the microphone. Alternatively, the measurement may be tied to an atmospheric pressure differential. For instance, a one atmospheric differential across the diaphragm may be utilized.

In one arrangement of the present aspect, the surface of the housing is a recessed surface over which the diaphragm is positioned. In this arrangement, the depth of the recessed surface may vary across at least a portion of its width as measured from a static position of the diaphragm.

According to another aspect of the invention, a microphone is provided that includes a recessed surface covered by a diaphragm. The diaphragm also defines a reference plane. The diaphragm and the recessed surface collectively define a chamber. Along at least one cross-sectional profile of the chamber, a perpendicular distance between the reference plane and the recessed surface continually increases between a first edge of the recessed surface and a midpoint of the recessed surface. However, such a microphone may include other cross-sectional profiles where the depth of the recess does not continually increase between a peripheral edge and a mid point. For instance, one or more cross-sectional profiles of the recessed surface may have one or more flat sections that have a constant spacing from the diaphragm.

According to another aspect of the present invention, an implantable microphone having enhanced pressure sensitivity is provided wherein upon a deflection of a diaphragm in response to a predetermined pressure differential, an entirety of a recessed surface beneath the diaphragm is disposed within 0.0005 inches of the deflected diaphragm. In such an arrangement, a recessed surface may be shaped to match a deflection profile of a diaphragm.

As will be appreciated, different diaphragms may have different deflection profiles. For instance, for a diaphragm that acts as a membrane, a deflection may be parabolic. In contrast, for a thicker diaphragm that deflects as a plate, a deflection may be less near its boundary than for a diaphragm, owing to the plate's stiffness in bending. The shape of the chamber may be matched in the appropriate diaphragm deflection profile in order to maintain an entirety of the recessed surface within a predetermined distance of the diaphragm upon maximum expected deflection.

DETAILED DESCRIPTION

Reference will now be made to the accompanying drawings, which at least assist in illustrating the various pertinent features of the present invention. In this regard, the following description of a hearing aid device is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
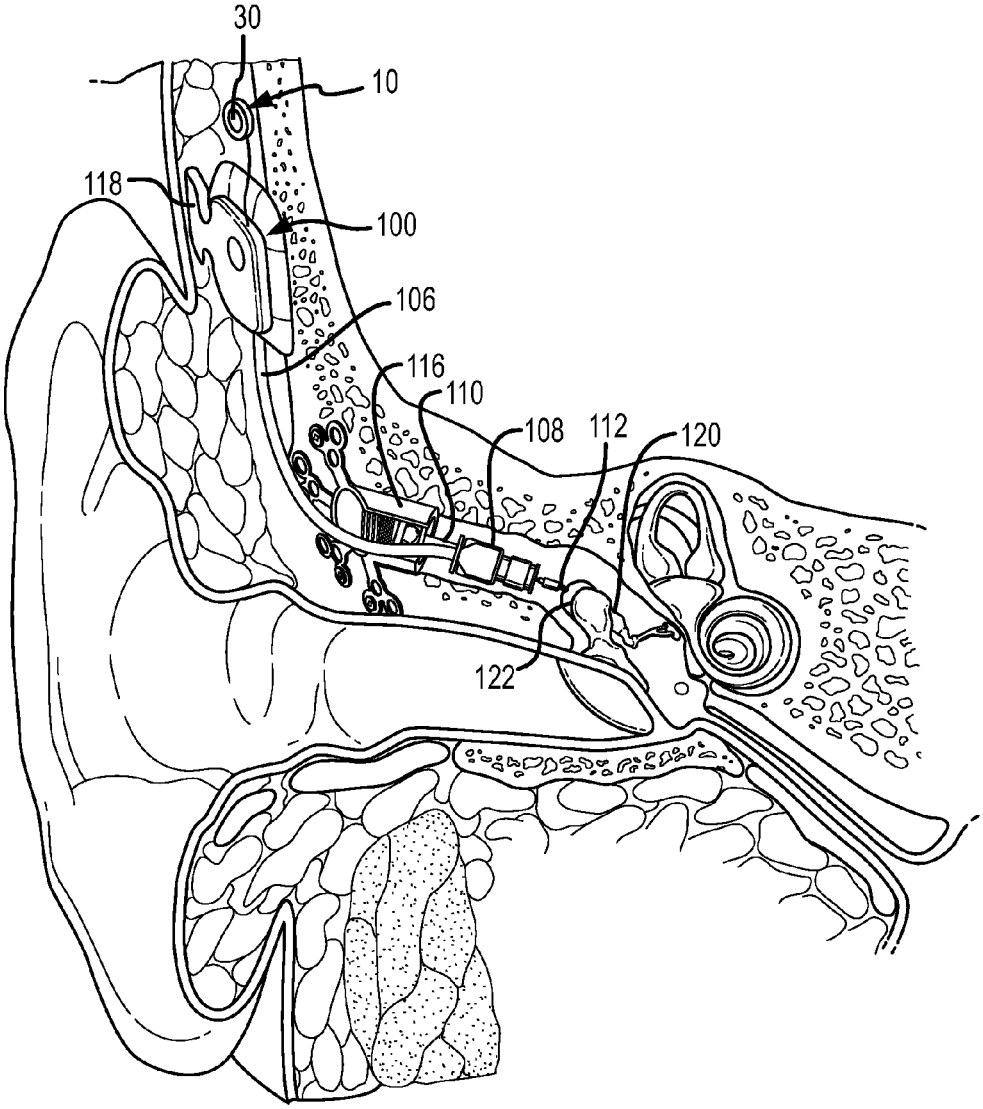
FIG. 1 illustrates a fully implantable hearing instrument in which the microphone may be incorporated.

Hearing Instrument System:

FIG. 1 illustrates one fully implantable hearing instrument system in which an implantable microphone having enhanced pressure sensitivity may be utilized. However, the enhanced pressure sensitive implantable microphone may be employed in conjunction with semi-implantable hearing instruments as well as other fully implantable hearing instruments (e.g., cochlear implants, floating mass transducer systems, etc.), and therefore the application presented herein is for purposes of illustration and not limitation.

In the illustrated system, a biocompatible implant housing 100 is located subcutaneously on a patient's skull. The implant housing 100 includes a signal receiver 118 (e.g., comprising a coil element) and may include an integrated microphone or an separate implantable microphone 10 that is interconnected to the housing 100 via an electrical connector. In either case, the microphone 10 will include a diaphragm 30 that is positioned to receive acoustic signals through overlying tissue. The implant housing 100 may be utilized to house a number of components of the fully implantable hearing instrument. For instance, the implant housing 100 may house an energy storage device, a microphone transducer, and a signal processor. Various additional processing logic and/or circuitry components may also be included in the implant housing 100 as a matter of design choice. Typically, the signal processor within the implant housing 100 is electrically interconnected via wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

During normal operation, acoustic signals are received subcutaneously at the microphone 10, which generates signals for receipt by the housing 100. Upon receipt of the signals, a signal processor within the implant housing 100 processes the signals to provide a processed audio drive signal via wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

To power the fully implantable hearing instrument system of FIG. 1, an external charger (not shown) may be utilized to transcutaneously re-charge an energy storage device within the implant housing 100. In this regard, the external charger may be configured for disposition behind the ear of the implant wearer in alignment with the signal receiver 118 connected to the implant housing 100. The external charger and the implant housing 100 may each include one or more magnets to facilitate retentive juxtaposed positioning. Such an external charger may include a power source and a transmitter that is operative to transcutaneously transmit, for example, RF signals to the signal receiver 118. In this regard, the signal receiver 118 may also include, for example, rectifying circuitry to convert a received signal into an electrical signal for use in charging the energy storage device. In addition to being operative to recharge the on-board energy storage device, such an external charger may also provide program instructions to the processor of the fully implantable hearing instrument system.

Figure 2:
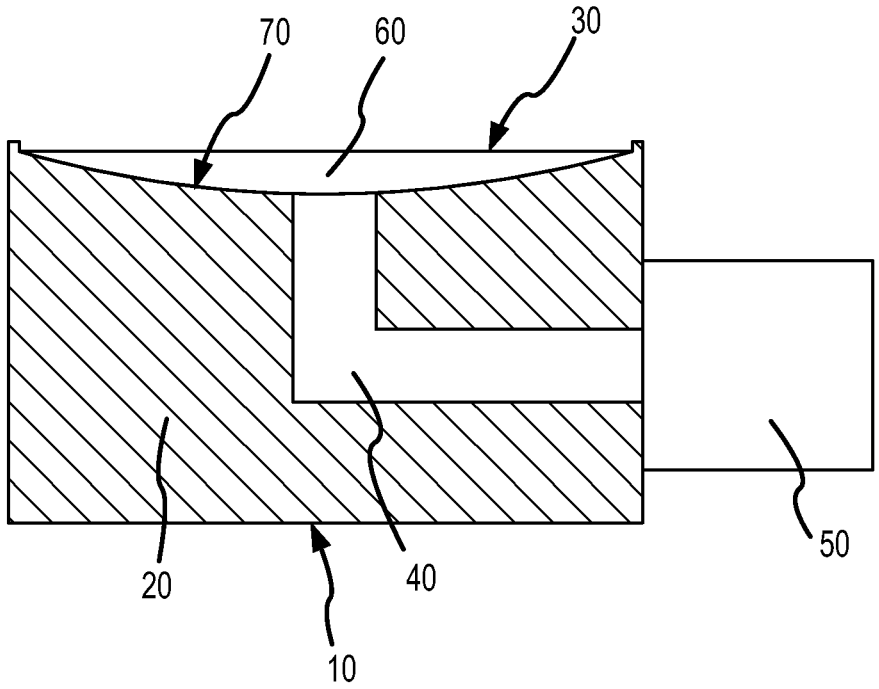
FIG. 2 illustrates a cross sectional view of a first embodiment of an implantable microphone.

Microphone:

FIG. 2 illustrates one embodiment of an implantable microphone 10 that is designed to have enhanced pressure sensitivity. The implantable microphone 10 includes a housing 20, an attached diaphragm 30, a port 40, and a microphone element 50. A chamber 60 is formed between the diaphragm 30 and a recessed surface 70 of the housing. More specifically, the diaphragm 30 is sealably positioned across the recessed surface 70 of the housing 20 to define the chamber 60 while also providing a hermetic barrier for the microphone. When the diaphragm 30 is displaced inward by a positive pressure from the outside, e.g., as caused by pressure waves transmitted through overlying tissue, it takes on a deformed shape determined by the applied pressure, the geometry of the diaphragm and the material properties of the diaphragm. The deformed shape of the diaphragm displaces or "sweeps out" a volume of gas within the chamber 60 into the port 40, where the microphone element 50 is operative to monitor pressure variations and generate an output signal indicative thereof.

As shown, the port 40 forms a communicating lumen between the chamber and the pressure sensitive microphone element 50. When the diaphragm 30 is in a static position (e.g., non-deflected), the chamber 60 has a static or equilibrium volume V0. This equilibrium volume includes the volume trapped between the diaphragm 30 and the bottom of the chamber 60, plus the volume of the port 40 and an effective trapped volume due to the compliance of microphone element 50. As will be appreciated, the volume of the port can be made significantly smaller by making the lumen small in diameter and short. In another arrangement, the port 40 may be eliminated (e.g., an electret microphone element may be disposed directly within the chamber 60).

For acoustic signals, changes in volume occur so rapidly that they are essentially adiabatic. Under these conditions, the adiabatic law is followed:

$$PV^{\gamma}=\text{const} \qquad \text{Equation (1)}$$

Taking the full derivative and solving for the change in pressure for a change in volume provides the following formula:

$$\frac{dP}{dV}=\frac{P_0\gamma}{V_0} \qquad \text{Equation (2)}$$

where $P_0$ and $V_0$ are the equilibrium pressure and volume, respectively, and $\gamma$ is the ratio of the specific heats for the gas, typically 1.4. This shows that the smaller the equilibrium volume, the more sensitive the microphone 10 will be. For instance, reducing the chamber volume by half will double the sensitivity of the microphone. Accordingly, it would be desirable to reduce the volume of the microphone chamber while still permitting the diaphragm to respond to acoustic excitation without distortion.

During normal operation, a space must be maintained between the diaphragm 30 and the recessed surface 70 or the diaphragm 30 will contact the recessed surface 70 (i.e., during acoustic excitation) causing distortion of a resulting output signal of the microphone element 50. For instance, a minimum tolerance spacing between the recessed surface 70 and a maximum expected deflection of the diaphragm 30 is desirable. Mechanical tolerances, diaphragm deformation during welding, and changes in atmospheric pressure determine a minimum spacing that will prevent distortion. However, it is noted that the change in the shape of the diaphragm 30 to all of these determining factors as well as displacement caused by acoustic excitation is minimum at the perimeter of the diaphragm 30 due to the rigid support of the housing 20 at the perimeter, and maximum only at the center (e.g., of a circular diaphragm). That is, the center of the diaphragm 30 experiences greater deflection than the peripheral edge of the diaphragm. Therefore, less spacing between the diaphragm 30 and the recessed surface 70 is required at the periphery of the diaphragm 30 than at the center of the diaphragm 30. Accordingly, a significant reduction in chamber volume can be realized by causing the spacing between the diaphragm 30 and recessed surface 70 to vary across the width of the chamber 60. As illustrated, the chamber 60 is shaped such that it is deeper at its center than at its edges.

That is, the recessed surface 70 has a profile that substantially matches the profile of the diaphragm 30 when the diaphragm is deflected. In this regard, the depth of the recessed surface (e.g., as measured from a non-deflected diaphragm) may increase as a function of a distance from an edge of the diaphragm. For instance, for a circular diaphragm, the depth of the recessed surface may change with radius, rather than maintaining a constant spacing with radius. In addition, the recessed surface 70 may be spaced to provide a tolerance between the recessed surface 70 and a maximum anticipated deflection of the diaphragm 30.

Multiple different profiles for the recessed surface 70 are possible. Two such profiles include parabolic and conical profiles. Generally, profiles that correspond with a surface of revolution are easier to machine. However, this is not a requirement. For instance, a recessed surface having a tetrahedral shape may also be utilized. The shape of several such profiles, and the relative volume compared with a cylindrical space of the same central depth, are compared in Table 1. With a differential pressure across the diaphragm 30, a diaphragm that is thin or under enough tension to act as a membrane will deform with a parabolic profile, while a plate will deform under pressure with a "plate deformation" profile. An additional requirement for the recessed surface is imposed as a thin, low tension diaphragm undergoes a change in shape when welded. This initial deformed shape is similar to the deformed shape of a plate under pressure, and must be taken into account when designing the recessed surface 70 so as to afford clearance for the diaphragm.

TABLE 1

| Cavity Bottom Profile | Equation of spacing<br>s = spacing at radius r<br>s0 = spacing at center<br>r0 = radius of perimeter | Volume Relative to Cylinder |
|---|---|---|
| Cylinder | s = s0 | 1 |
| Conical | s = s0 (1 − r/r0) | ⅓ |
| Parabolic | s = s0 (1 − (r/r0)^2) | ½ |
| Plate Deformation | s = s0 (1− (r/r0)^2)^2 | ⅓ |

As shown here, a chamber having conical profile reduces the chamber volume to ⅓ of a cylindrical chamber. If this were the only compliance in the microphone 10, the pressure sensitivity to volume would be increased by a factor of 3, or 9.5 dB, while a parabolic shape would be increased by a factor of 2 to provide an additional sensitivity of 6 dB under the same circumstances. In practice, due to the compliance of the microphone element, these improvements in sensitivity are not wholly realized, but improvements of one-half of these values or more are obtainable. Further, a small constant additional spacing may be added to these profiles in order provide a tolerance spacing. Accordingly, such a tolerance spacing will slightly reduce the theoretical improvement in sensitivity that may be achieved using a shaped microphone chamber.

Figure 3:
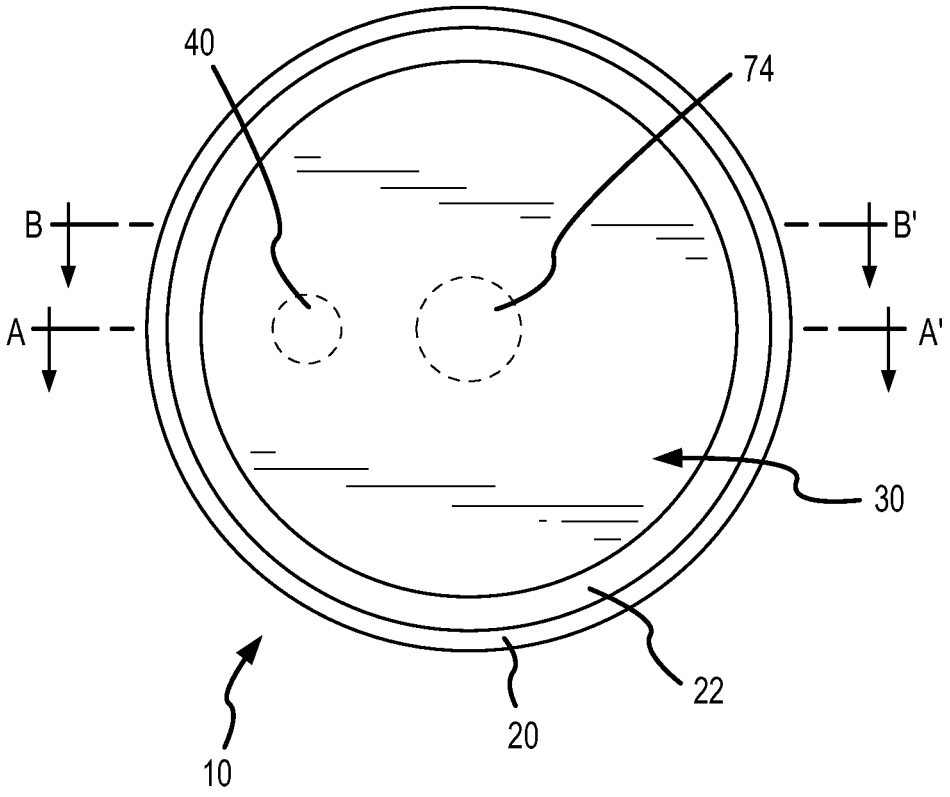
FIG. 3 illustrates a top view of a second embodiment of an implantable microphone.
Figure 4A:
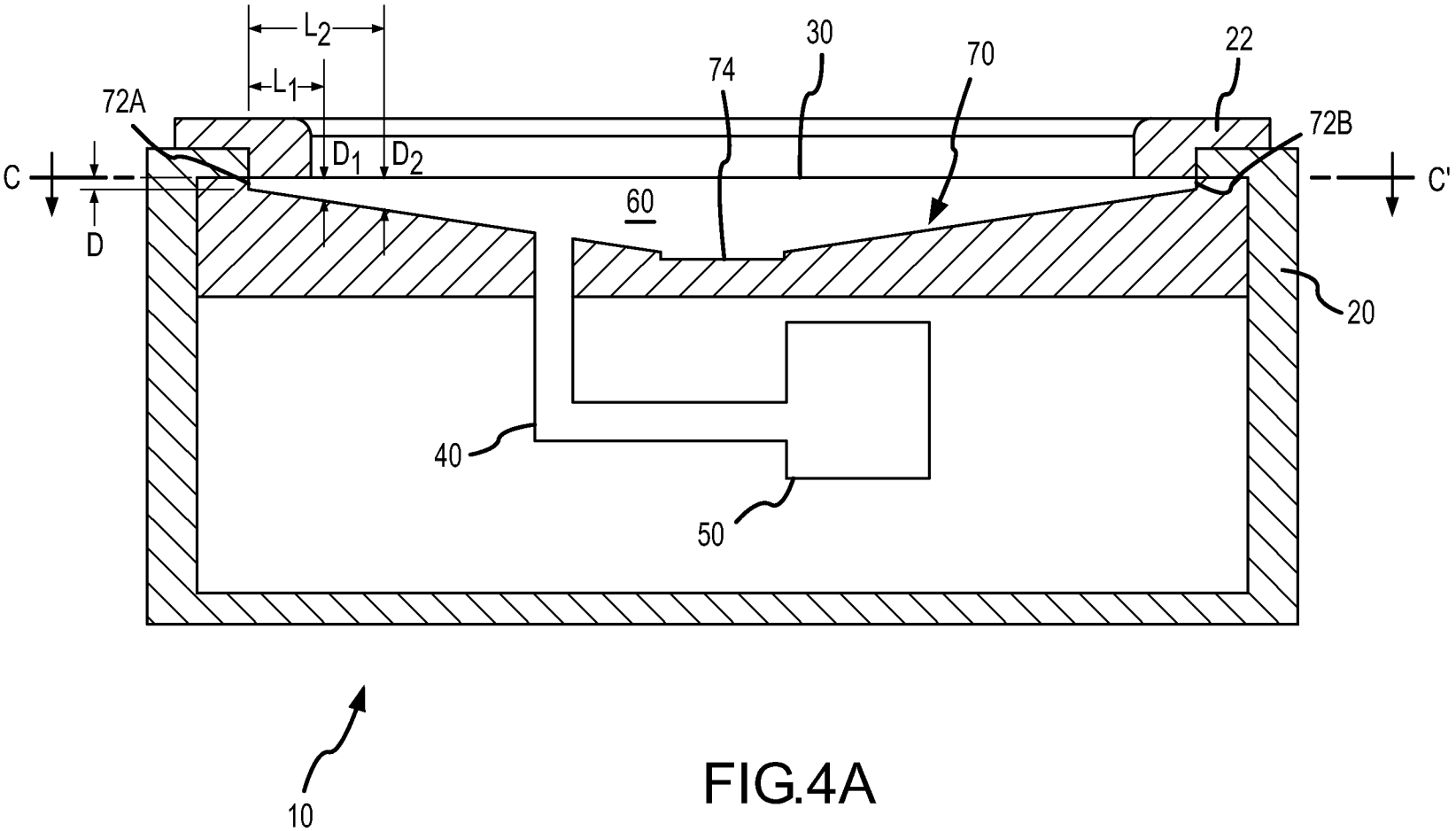
FIG. 4A illustrates a first cross-sectional view of the implantable microphone of FIG. 3.
Figure 4B:
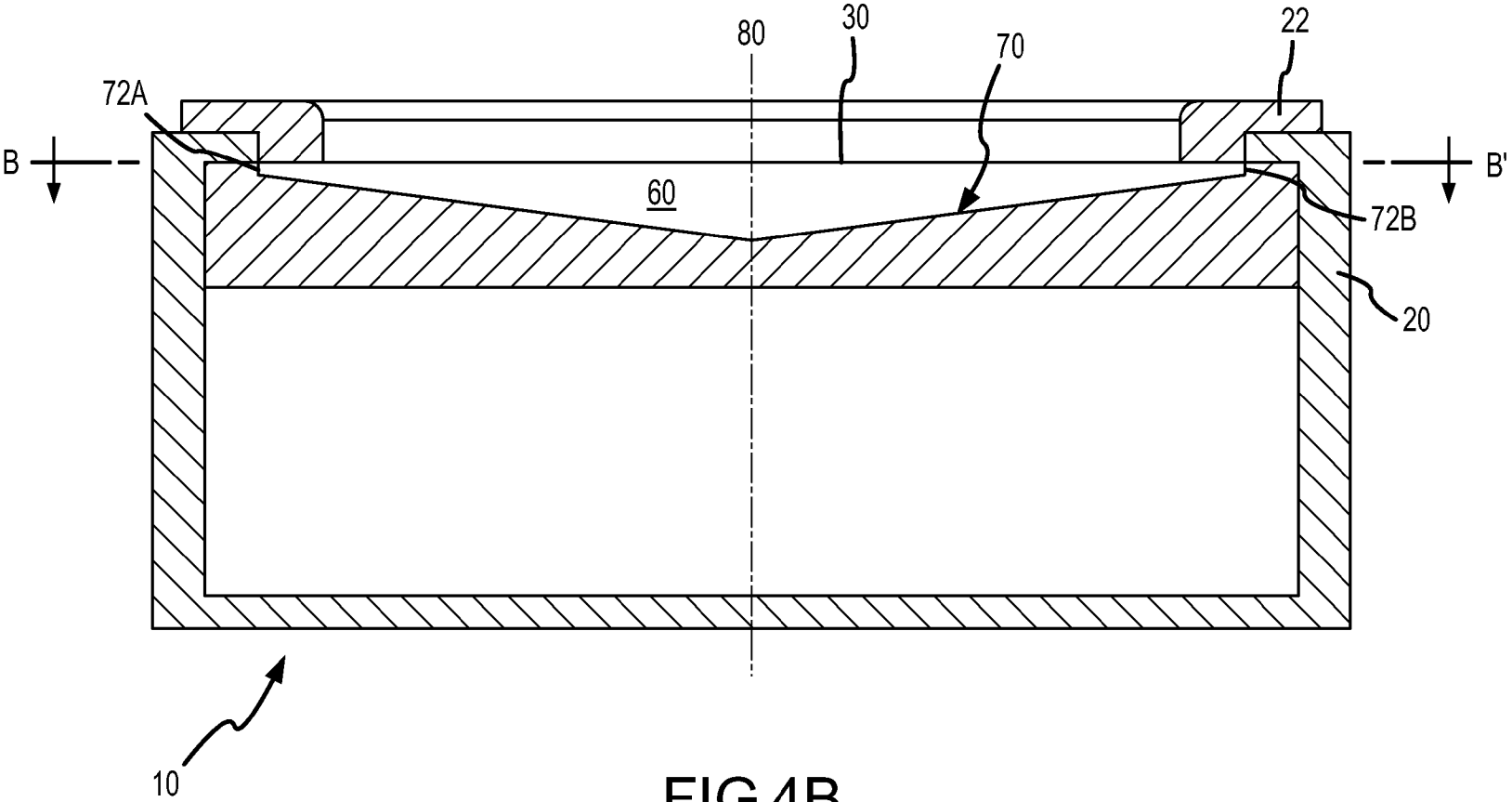
FIG. 4B illustrates a second cross-sectional view of the implantable microphone of FIG. 3.

FIGS. 3, 4A and 4B illustrate another embodiment of an enhanced pressure sensitive microphone 10. Again, the microphone 10 includes a housing 20 having a recessed surface 70 where a diaphragm 30 extends over the recessed surface 70 to define a chamber 60. In the illustrated embodiment, the housing 20 includes a ring member 22 that is adapted to interconnect the diaphragm 30 to the housing 20. In this regard, the peripheral edge of the diaphragm 30 is fixably interconnected between a top edge of the housing 20 and the ring member 22. Accordingly, the ring member may be permanently affixed to the housing 20 (e.g., by laser welding).

FIG. 4A shows a first cross-sectional profile of the microphone 10 of FIG. 3 taken through the center of the microphone along section lines A-A'. As shown, the diaphragm 30 is in a static/non-deflected position. In this static position, the diaphragm 30 defines a reference plane C-C'. Of note, a perpendicular or normal distance between the reference plane C-C' and the recessed surface 70 varies across the width of the microphone 10. More specifically, the normal distance between the diaphragm 30 and the recessed surface 70 generally increases from a minimum at a peripheral edge 72 to a maximum at a center section 74. In the embodiment shown, the recessed surface 70 is generally a truncated cone. Stated otherwise, the recessed surface 70 is frustoconical. FIG. 4B shows a second cross-sectional profile of the microphone 10 of FIG. 3 as taken at a location offset from the center of the microphone along section line B-B'. As shown in this profile, the recessed surface 70 continually increases in depth between the peripheral edges 72A, 72B and a midpoint 80 between the peripheral edges.

As will be appreciated, when the diaphragm 30 deflects inward in response to a sound pressure (e.g., acoustic excitation), the maximum deflection/displacement of the diaphragm 30 will occur at the unsupported center of the diaphragm 30. To accommodate the differing displacement of the diaphragm 30 across its width while reducing the volume of the chamber 70, the depth of the recessed surface 70 may increase in accordance with an expected deflection of the diaphragm 30. For instance, as shown in FIG. 4A, the recessed surface 70 may continually increase in depth between a peripheral edge 72 and a perimeter of the flat central portion 74. Such increase in depth may be linear (e.g. forming a conical recessed surface) or non-linear (e.g., forming a parabolic or other recessed surface).

As shown, the recessed surface 70 has an initial depth D at the peripheral edge 72 of the diaphragm 30. The depth of the remainder of the recessed surface typically increases to the center of the diaphragm. In this regard, at a first distance L1 from the peripheral edge 72, the recessed surface may have a depth of D1 that is greater than the initial depth D. Likewise, at a second location $L_2$ from the peripheral edge 72 (where L2 is greater than L1) the recessed surface may have a depth of D2 that is greater than D1. As noted, such increasing depth of the recessed surface 70 allows for increased deflection of the diaphragm 30 without the diaphragm contacting the recessed surface 70.

The housing 20 and diaphragm 30 are preferably constructed from biocompatible materials. In particular, titanium and/or biocompatible titanium-containing alloys may be utilized for the construction of such components. By way of example, the diaphragm 30 may be formed of titanium or a titanium alloy, and may be of a flat, disk-shaped configuration having a thickness of between about 10 and 200 microns, and most preferably between about 50 and 150 microns.

However, it will be appreciated that any biocompatible material may be utilized to form the diaphragm 30 if the biocompatible material has acceptable material properties. For instance, to achieve a desired yield resonance frequency, it may be desirable that selected material have a modulus of elasticity of at least about 70 GPa and more preferably of at least about 100 GPa. Non-limiting examples of biocompatible materials that may be utilized include gold, titanium, titanium alloys and stainless steels.

As illustrated herein, the diaphragm 30 and the chamber 60 are circular. However, it will be appreciated that other shapes may be utilized as well. In any case, it may be preferable to size the chamber to affect the frequency response of the diaphragm. For instance, it may be desirable to reduce the acoustic compliance of the chamber 60 for frequency response purposes. Such a reduction in acoustic response may be achieved by reducing the overall volume of the chamber. In one arrangement, the chamber is no larger than about 15 $mm^3$ and more preferably no larger than about 8 $mm^3$. Accordingly, the dimensions of the diaphragm (e.g., diameter) and the recessed surface 70 (e.g., depth) may be selected to generate a desired chamber volume. By way of example, a circular diaphragm may have a diameter of less than about 20 mm and more preferably less than about 15 mm. As note, the depth of the recessed surface 70 varies such that is deeper at its center than at its edges. In this regard, the depth of the recessed surface (e.g., as measured from the diaphragm) may be between about 0.0 inches and 0.0050 inches. In one particular embodiment, the diaphragm has a diameter of 10 mm, the chamber varies in depth from about 0.0008 inches at its peripheral edge to a maximum depth of 0.0030 inches near its center. In such an embodiment, the chamber has a volume of approximately 3.5 $mm^3$.

Preferably, upon a maximum expected deflection of the diaphragm 30, the entirety of the recessed surface 70 is disposed within a small tolerance of the diaphragm 30. For instance, the entirety of the recessed surface 70 may be at a distance of less than about 0.0015 inches. In a further arrangement, the entirety of the recessed surface 70 may be within about 0.0005 inches. By reducing the distance between the diaphragm 30 and recessed surface, displacement of fluid (i.e., gas/air) within the chamber 60 may be enhanced. In any arrangement, it may be preferable that a minimum distance be maintained between the diaphragm 30 and recessed surface 70. This minimum distance, or, tolerance may be at least 0.0001 inches and more preferably 0.0002 inches.

Though discussed above as utilizing a substantially conical recessed surface 70, it will be appreciated that any other profile shape that generally increases in depth may be utilized. For instance, any shape where the depth of the recessed surface 70 in relation to the reference plane $C\text{-}C_1$ increases as a function of the distance from the peripheral edge 72 may be utilized. In alternate embodiments, the recessed surface 70 may include a stair step pattern where successive annular portions of the recessed surface increase in depth. However, it has been determined that recessed surface 70 having a substantially smooth surface facilitates the compression of gases within the chamber 60 into the port 40. In this latter regard, it will be noted that the port 40 need not be centrally located within the recessed surface 70. That is, use of a substantially smooth recessed surface allows the port 40 to be offset from the center of the microphone 10 without affecting microphone performance.

Figure 5A:
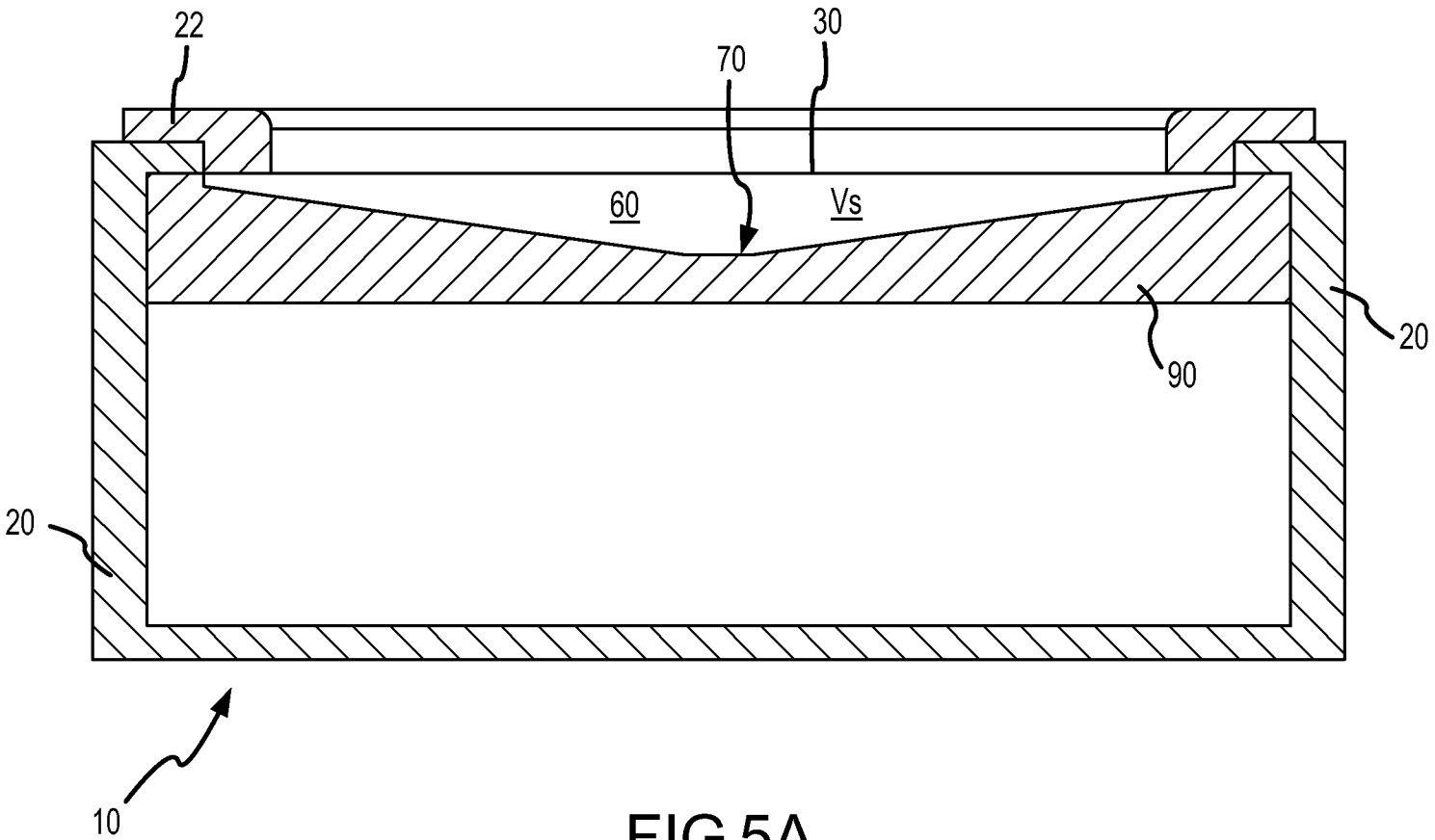
FIG. 5A illustrates an implantable microphone with a diaphragm in a static orientation.
Figure 5B:
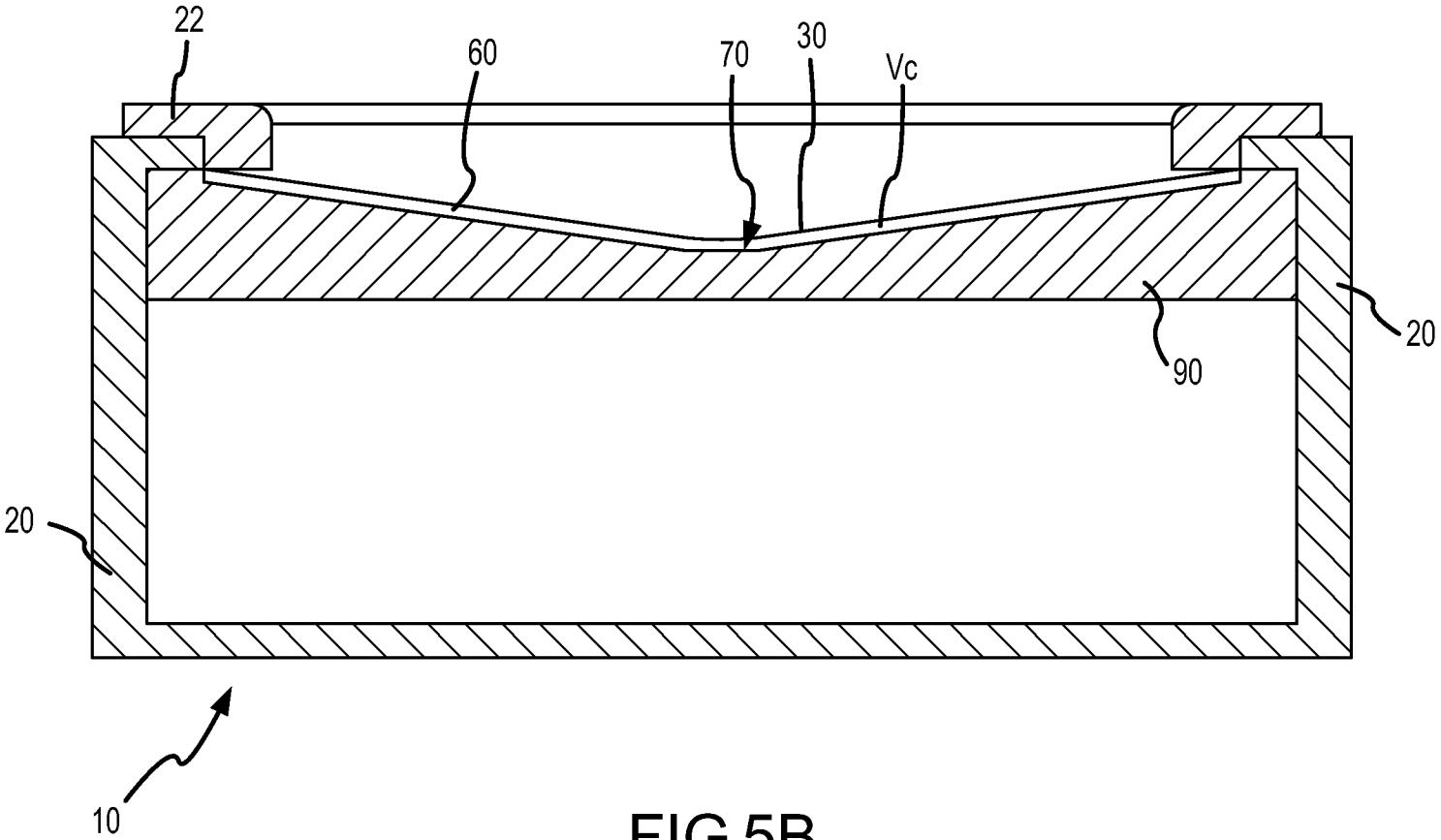
FIG. 5B illustrates the microphone of FIG. 5A with the diaphragm in a deflected orientation.

FIGS. 5A and 5B illustrate a microphone 10 having a diaphragm in a static/non-deflected orientation and in a deflected orientation, respectively. As shown in FIG. 5A, when the diaphragm 30 is at rest (e.g., static) the chamber 60 has a static volume Vs. FIG. 5B illustrates the deflection of the diaphragm 30 toward the recessed surface 70 in response to an applied pressure differential across the microphone. As shown, under the applied pressure differential, the diaphragm 30 deflects towards the recessed surface 70 such that the chamber 60 has a compressed volume Vc. Use of a chamber defined by a surface that varies in depth allows for substantially reducing the compressed volume Vc in comparison to the static volume Vs (i.e., ratio of volumes). This reduction in the compressed volume Vc allows for the pressures created within the chamber 60 for a given deflection of the diaphragm 30 to be enhanced.

By way of example, for a microphone having a non-shaped cylindrical recessed surface (not shown) with a depth D that is approximately 7.5 percent of the diaphragm diameter, a maximum deflection may occur (e.g., at a one-atmosphere pressure differential across the diaphragm) where a center of the diaphragm just contacts the bottom of the recessed surface. Assuming a parabolic deformation of the diaphragm, the compressed volume Vc of the microphone chamber will be approximately 50 percent of the static volume Vs of the microphone chamber. In contrast, a microphone having a recessed surface that is shaped to approximate the deformation of a diaphragm will have a much lower ratio of volumes. For instance, for a microphone having a truncated conical recessed surface with a center depth D that is approximately 7.5 percent of the diaphragm diameter, a maximum deflection may also occur (e.g., at a one-atmosphere pressure differential across the diaphragm) when a center of the diaphragm just contacts a flat portion of the recessed surface. Again assuming parabolic deformation of the diaphragm, the compressed volume Vc of the microphone chamber will be approximately 10 percent of the static volume Vs of the microphone chamber. In this regard, the ratio of volumes (i.e., Vc/Vs) may be substantially less for a microphone with a shaped chamber than the ratio of a microphone that utilizes a generally cylindrical chamber. Likewise, the pressure generated in a shaped chamber microphone may be substantially greater than the pressure generated in a cylindrical chamber.

The above comparison represents a near maximum displacement of a microphone diaphragm. However, it will be appreciated that similar results exist for smaller diaphragm displacements (e.g., associated with smaller pressure differentials). In any case, a ratio of volumes in response to a predetermined pressure differential of less than about 40 percent, more preferably less than about 30 percent, and even more preferably less than 20 percent, represents a sizable improvement for implantable microphones.

Of further note, the microphone 10 as illustrated in FIGS. 5A and 5B does not utilize a electroacoustic microphone element (e.g., see FIG. 4A) to sense pressure fluctuations with the chamber 60. Rather, the microphone 10 as shown in FIGS. 5A and 5B utilizes a conductive element 90 to form the recessed surface 70. In this arrangement, the entire microphone assembly effectively forms an electret thereby dispensing with the need for a separate electroacoustic transducer. For instance, the diaphragm 30 may form a first electrode and the conductive element 90 may form a second electrode, which may be electrically isolated from the first electrode. By monitoring an electrical property between the electrodes, an output that is indicative of a pressure applied to and/or by the diaphragm 30 may be generated. The conductive element 98 may be formed from, for example, a piezoelectric material or from a conductive metal (e.g., titanium). What is important is that the conductive element be operative to generate an electrical output that varies with a pressure in the chamber 60 of the microphone 10. As will be appreciated, the arrangement of FIGS. 5A and 5B may eliminate the need for a port between the chamber 60 and a electroacoustic transducer 50 (e.g., see FIG. 4A) thereby further reducing the total volume of the microphone 10. Accordingly, this may allow for generating increased pressures within the chamber 60.

Those skilled in the art will appreciate variations of the above-described embodiments that fall within the scope of the invention. As a result, the invention is not limited to the specific examples and illustrations discussed above, but only by the following claims and their equivalents.

What is claimed:

1. An implantable microphone, comprising:

a housing;

a diaphragm sealably positioned across and spaced from a recessed surface of the housing, wherein said recessed surface and said diaphragm collectively define a chamber therebetween and wherein said diaphragm defines a reference plane;

a pressure sensitive element operatively interconnected to said chamber for detecting pressure fluctuations and generating an output signal, said output signal being operative to actuate an actuator of a hearing instrument; and wherein a perpendicular distance between said reference plane and said recessed surface, over at least a portion of a width of said recessed surface, increases as a function of a horizontal distance from a peripheral edge of said recessed surface.

2. The microphone of claim 1, wherein a center of said recessed surface is deeper than a peripheral edge of said recessed surface, and wherein said depth of said recessed surface varies in a range between 0.0 inches and about 0.0050 inches.

3. The microphone of claim 2, wherein said depth of said recessed surface varies in a range between about 0.0002 inches and about 0.0030 inches.

4. The microphone of claim 1, wherein a volume of said chamber is less than about 15 cubic millimeters.

5. The microphone of claim 4, where said volume is less than about 7 cubic millimeters.

6. The microphone of claim 1, wherein said diaphragm has a modulus of elasticity of at least about 70 GPa.

7. The microphone of claim 6, wherein said diaphragm has a modulus of elasticity of at least about 100 GPa.

8. The microphone of claim 1, wherein said diaphragm has a thickness between about 0.0002 in and about 0.008 in.

9. The microphone of claim 1, wherein said diaphragm is operative to deflect toward said recessed surface in response to a pressure differential across said diaphragm, and wherein in response to a predetermined pressure differential an entirety of said recessed surface is at a distance of less than 0.0015 in. from said diaphragm.

10. The microphone of claim 9, wherein an entirety of said recessed surface is at a distance of less than 0.0005 in. from said diaphragm.

11. The microphone of claim 10, wherein no portion of said recessed surface is at a distance of less than 0.0002 in. from said diaphragm.

12. An implantable microphone, comprising:

a housing;

a diaphragm sealably positioned across and spaced from a recessed surface of the housing, wherein said recessed surface and said diaphragm collectively define a chamber therebetween and wherein said diaphragm defines a reference plane; and a pressure sensitive element operatively interconnected to said chamber for detecting pressure fluctuations and generating an output signal, said output signal being operative to actuate an actuator of a hearing instrument, wherein a perpendicular distance between said reference plane and said recessed surface, over at least a portion of a width of said recessed surface, increases as a function of a horizontal distance from a peripheral edge of said recessed surface, wherein a diameter of said recessed surface is less than 30 mm.

13. The microphone of claim 12, wherein said function is a linear function.

14. The microphone of claim 12, wherein said function is a non-linear function.

15. The microphone of claim 12, wherein a cross-sectional profile of said recessed surface is at least one of parabolic or conical over at least a portion of said recessed surface.

16. The microphone of claim 12, wherein a periphery of said recessed surface is circular.

17. An implantable microphone, comprising:

a chamber at least in part established by a diaphragm and a surface that is recessed from the diaphragm; and a pressure sensitive apparatus configured to generate an output signal indicative of a pressure fluctuation sensed thereby, wherein a geometric center of a location of pressure communication between the pressure sensitive apparatus is offset from a geometric center of the chamber.

18. The implantable microphone of claim 17, further comprising:

a port extending from the chamber to the pressure sensitive apparatus placing the chamber in pressure communication with the pressure sensitive apparatus, wherein the interface between the port and the chamber corresponds to the location of pressure communication.

19. The implantable microphone of claim 17, wherein:

the chamber is further established by a surface of the pressure sensitive element, the surface of the pressure sensitive element corresponding to the location of pressure communication.

20. The implantable microphone of claim 17, wherein:

the microphone is configured such that a maximum deflection of the diaphragm places a portion thereof beyond, relative to a location of the diaphragm in an undeflected state, at least a portion of the location of pressure communication.

* * * * *